United States Patent [19]

Schaumberg

[11] 4,137,807

[45] Feb. 6, 1979

[54] MANUAL SLICER AND DICER APPARATUS FOR FRUITS AND VEGETABLES

[76] Inventor: Arnold G. Schaumberg, Rte. 3, Box 295, Hartford, Wis. 53027

[21] Appl. No.: 821,396

[22] Filed: Aug. 3, 1977

[51] Int. Cl.[2] ..... B26D 3/18; B26D 3/26

[52] U.S. Cl. ..... 83/599; 83/620; 83/858; 83/564; 83/651.1

[58] Field of Search ..... 83/597, 599, 620, 857, 83/858, 564, 651.1

[56] References Cited

U.S. PATENT DOCUMENTS

| | | | |
|---|---|---|---|
| 1,097,479 | 5/1914 | Starr | 83/858 |
| 1,614,282 | 1/1927 | Cleary | 83/607 |
| 1,656,415 | 1/1928 | Breitkrentz | 83/620 |
| 3,216,474 | 11/1965 | Popeil | 83/858 X |

*Primary Examiner*—Willie G. Abercrombie

*Attorney, Agent, or Firm*—McCaleb, Lucas & Brugman

[57] ABSTRACT

A convenient and inexpensive apparatus for slicing, dicing and cutting foodstuffs, such as fruits and vegetables, especially those having varying densities throughout their volume, comprising a horizontal base member having a plurality of upstanding peg members to support an article to be cut and a pivotable cutting frame supported by the base member and carrying a plurality of slicing knives each of which has a double-edged knife surface for cutting through the article. A detachable dicing frame can be slidably inserted adjacent the knife frame assembly for the dicing of an article.

3 Claims, 6 Drawing Figures

MANUAL SLICER AND DICER APPARATUS FOR FRUITS AND VEGETABLES

BACKGROUND OF THE INVENTION

1. Field of the Invention

This invention relates to manually-operated food cutting devices, and more particularly to vegetable and fruit slicer and dicer apparatus.

2. Description of Prior Art

Various prior art devices are available for slicing, dicing, serrating and otherwise cutting fruits and vegetables and other foodstuffs and among them are included the devices disclosed in U.S. Letters Pat. Nos. 1,614,282 and 1,558,369. These and other prior art devices utilize knife members which have been sharpened into a single cutting edge. However, in use, such single-edged knives are easily deflected when confronting and passing through a dense portion of an article being cut, as contrasted to adjacent softer portions which are easily cut. In other words, the sidewise deflection of such knives is disadvantageous in that articles are not uniformly sliced. Further, the base members for such slicing and dicing devices are oftentimes damaged due to a slicing blade entering the base in a deflected and distorted position.

SUMMARY OF THE INVENTION

The present invention comprises a manually-operated vegetable and fruit slicer and dicer device which utilizes a horizontal base member having an upper bed of upstanding peg members for supporting an article to be cut, a cutter assembly which is hingedly supported by the base member and also includes a handle member, and a plurality of knife members mounted on the cutter frame assembly each of which is formed with two cutting edges. A second cutter frame can be inserted over the knife members and at right angles thereto to effect dicing.

A primary object of the present invention is to provide a food slicing device which has blade members which will not be distorted or deflected from their straight and parallel-aligned operating positions when passing through hard or dense portions of foodstuff articles being cut.

Another object of this invention is to provide a food slicing apparatus that can easily be converted into a dicing device.

An additional object of this invention is to provide a vegetable and fruit cutting device which is economical and easy to use.

The means by which the foregoing and other objects of the present invention are accomplished and the manner of their accomplishment will be readily understood from the following specification upon reference to the accompanying drawings, in which.

DESCRIPTION OF THE PREFERRED EMBODIMENT

Figures 1, 3, 4:
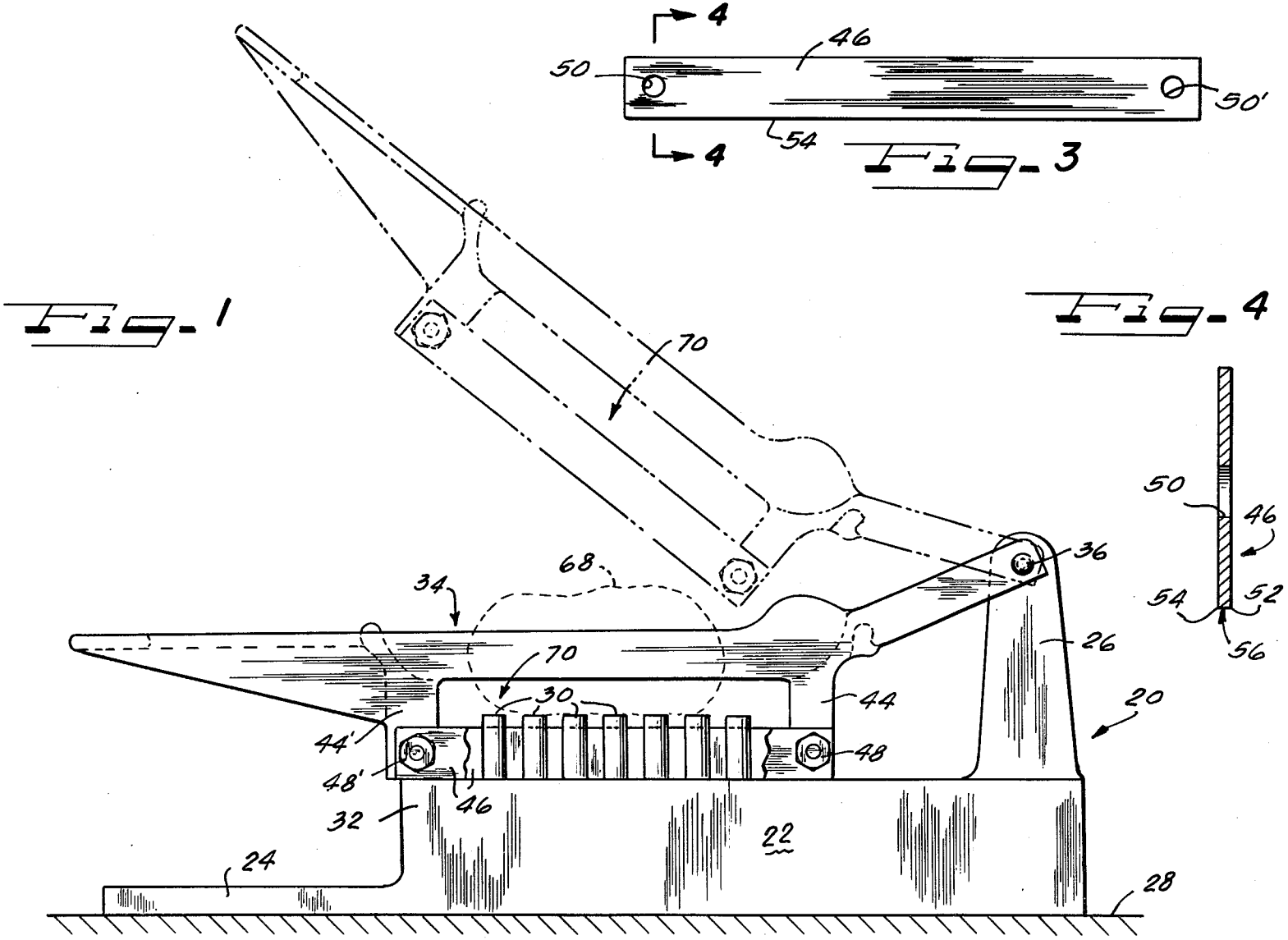
FIG. 1 is a side elevational view of the vegetable and fruit cutting device herein disclosed, depicting in solid lines its fully closed position and in phantom lines a partially open position, and with certain cutting elements fragmented for better viewing.
FIG. 3 is a side elevation of a single blade as used in the present invention.
FIG. 4 is an enlarged sectional view of the blade of FIG. 3, as taken along line 4—4 of FIG. 3.
Figure 2:
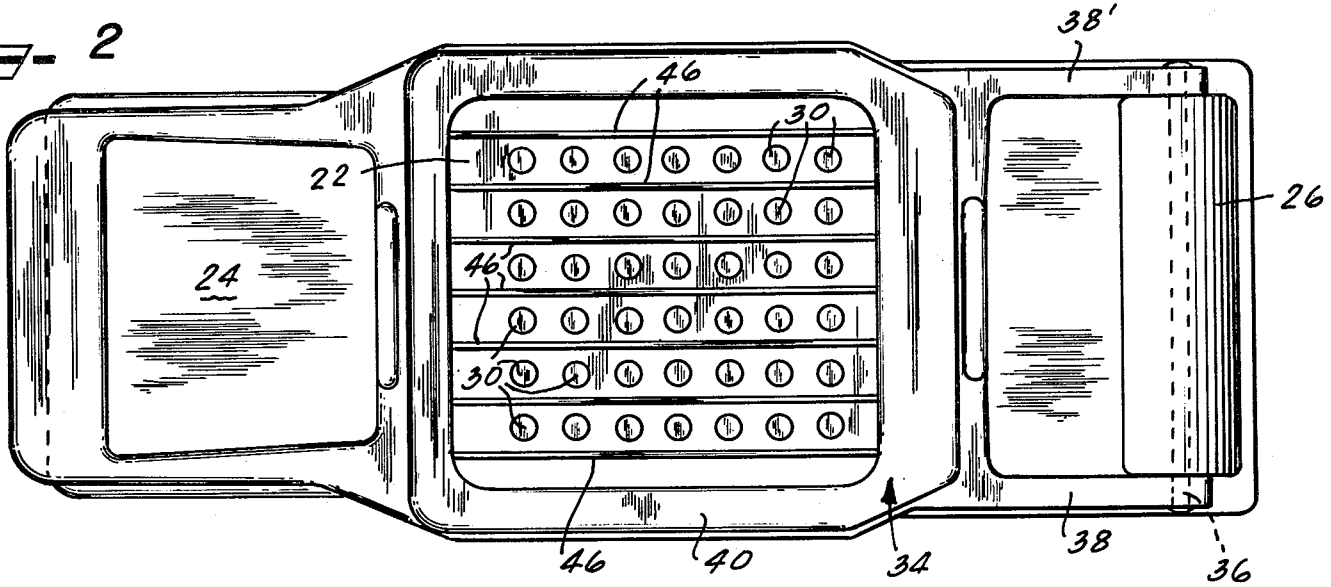
FIG. 2 is a plan view of the cutting device of FIG. 1 as viewed along line 2—2 thereof.

Having reference to the drawings, wherein like reference numerals indicate corresponding elements, there is shown in FIGS. 1 and 2 an illustration of a fruit and vegetable cutting apparatus of the form presently preferred, indicated generally by reference number 20. The cutting apparatus 20 includes a base member 22 which has a base extension 24 and an upwardly directed support leg 26 integrally formed therewith. The base 22 is preferably formed of a non-corrosive metal or high strength plastic material. The base 22 and extension 24 are, of course, used to give the cutting apparatus 20 the necessary stable horizontal support when placed and operated on a horizontal work surface, such as that indicated by reference number 28. A bed or plurality of upstanding peg members 30 are provided which may be formed integrally with the upper surface 32 of base member 22, and are aligned in right-angled columns and rows in a well known manner.

A cutter assembly, generally indicated by reference numeral 34, is pivotally hinged via pin 36 to the upper end of support leg 26. The cutter assembly 34 comprises two pivot arms 38, 38' (FIG. 2), a rectangularly configured knife frame 40, and a handle portion 24, all of which are also preferably formed from a non-corrosive metal or plastic material. A pair of downwardly extending rib members 44, 44' (FIG. 1) are integrally formed on the lower portion of knife frame 40 and extend transversely thereacross.

A series of specially configured knife blade members 46 are rigidly affixed to the ribs 44, 44' of knife frame 40 through use of threaded fasteners 48, 48' inserted through holes 50, 50' formed in the blades 46 and mating holes (not shown) formed along the length of ribs 44, 44'. The blades 46 are affixed in parallelism to frame 40 in longitudinal alignment of the cutter assembly 34, and thus, operate perpendicularly to the axis of rotation of assembly 34 with base member 22. Each blade 46 is formed with a planar cutting surface comprising two, right-angled cutting edges running the length thereof, as depicted by edges 52 and 54 in FIGS. 3 and 4. (The blades 46 are purposely not formed into a single, sharpened cutting edge, which is the case with the cutting members of most prior art devices causing attendant blade deflection problems.) Thus, a flattened surface 56, as well as the two distinct, squared-off cutting edges 52, 54 are presented to the article being cut during the operation of the present invention, which is described in more detail later herein.

Figure 6:
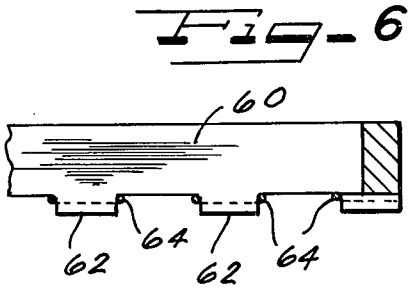
FIG. 6 is a sectional view of the dicing frame of FIG. 5 taken along line 6—6 thereof.
Figure 5:
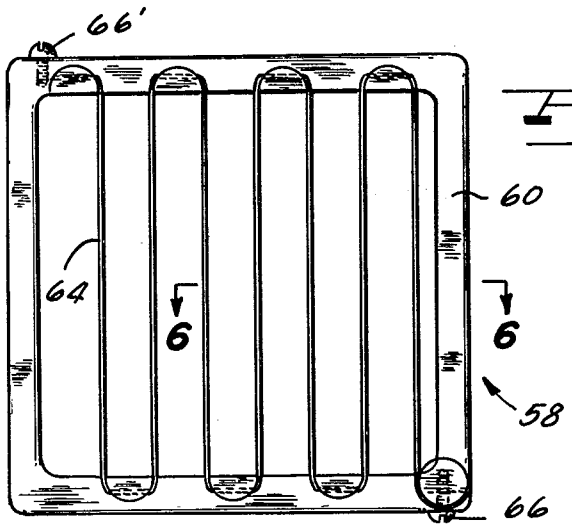
FIG. 5 is a bottom plan view of a dicing frame that can be used in conjunction with the present invention.

As seen in FIGS. 5 and 6, a dicer assembly 58 is formed of a rectangular-shaped dicing frame 60 — conforming to the shape of but slightly smaller than knife frame 40 — which has upstanding undercut projections 62 around which a dicing wire 64 (preferably formed of stainless steel) can be strung (FIG. 5). The wire 64 is tightly anchored to dicer frame 60 at its ends by fasteners 66, 66'.

Turning to the operation of the present invention, food slicing can be accomplished by first raising the cutter assembly 34 (phantom position in FIG. 1), placing the article to be cut on top of the bed of pegs 30, and then slowly depressing the cutter assembly 34 via handle 42 so as to engage each cutting edge 52, 54 of the blades 46 with the article (indicated in phantom in FIG. 1 by reference numeral 68) to be cut. As the two-edged blades 46 break the upper surface of article 68, continue on through the central portion, and finally break through the lower surface thereof, the blades 46 remain in substantially straight alignment as when free-standing (see FIG. 2). There is no bending or lateral deflection of blades 46 from their normal straight alignment as the blades 46 pass into and through dense or hardened interior portions of article 68, such as would happen with the single edge cutting members of prior art food cutting devices as they encountered denser areas in fruits and vegetables. Accordingly, the blades 46, when such locally dense areas are encountered during a cutting stroke, will not be laterally deflected into the peg members 30, with possible resultant damage to either the blades or pegs, and further result in improperly cut foodstuffs.

The fact that the pegs 30 extend up through the blades 46 when the latter rest on upper surface 32 of base 22 (FIG. 1), of course, assures that the lower surface of article 68 is clearly and completely cut through, i.e., so that individual food slices are continously produced.

The dicer assembly 58 of FIGS. 5 and 6 can be inserted — preferably by interference fit — into the sleeve opening space denoted by reference numeral 70 in FIG. 1 such that the parallel strands of dicing wire 64 lay perpendicular to the parallel knife blades 46. In this manner the dicer assembly 58 is correctly self-positioned over the knife frame 40 and allows a quick change over from a slicer to a dicer function, all without the use of any auxiliary fastening pins or clips. When the cutting apparatus 20 is so constructed, the article 68 is, of course, not only first sliced by blades 46 but then diced by dicing wire 64. The pegs 30 are preferably formed long enough to accommodate such a dicing assembly so as to effect complete dicing of the food article.

From the foregoing, it is believed that those skilled in the art will readily appreciate the unique features and advantages of the present invention over previous types of manual food cutting devices. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

The embodiments of the invention in which an exclusive property or privilege is claimed are defined as follows:

1. A manually-operated food cutting device comprising: a base member for providing horizontal support to the cutting apparatus, said base member further characterized as having a plurality of upstanding peg members mounted on the upper portion thereof to support the food article to be cut; a cutter assembly characterized as being pivotally mounted at one of its ends to said base member and having a handle portion at its other end and a knife support frame at its central portion; a plurality of cutting blades mounted on the knife support frame, each of said cutting blades characterized as presenting two substantially right-angled cutting edges to the food article being cut; sleeve mounting means carried by said knife support frame; and a dicing assembly characterized as having a dicer frame conforming to the shape of said knife support frame and a plurality of cutter means mounted in parallelism to said dicer frame, whereby said dicing assembly is operable to be mounted in said sleeve mounting means adjacent and at right-angle alignment to said knife support frame to effect dicing of the food article.

2. An elongated knife blade for use in a vegetable and fruit cutting apparatus characterized as having means for attachment to the cutting apparatus and an untensioned planar cutting portion comprising two sharpened, substantially right-angled cutting edges.

3. An elongated knife blade for use with a foodstuff cutting apparatus characterized as having a rectangular crosssection whereby the elongated cutting surface is planar and untensioned and comprises transversely across its face a flat surface intermediate two right-angled cutting edges.

* * * * *